US005091063A

United States Patent [19]

Lehmkuhl et al.

[11] Patent Number: 5,091,063

[45] Date of Patent: Feb. 25, 1992

[54] ORGANOALUMINUM ELECTROLYTES AND PROCESS FOR THE ELECTROLYTIC DEPOSITION OF ALUMINUM

[75] Inventors: Herbert Lehmkuhl; Klaus-Dieter Mehler, both of Mülheim/Ruhr, Fed. Rep. of Germany

[73] Assignee: Studiengesellschaft Kohle mbH, Mulheim/Ruhr, Fed. Rep. of Germany

[21] Appl. No.: 533,322

[22] Filed: Jun. 5, 1990

[30] Foreign Application Priority Data

Jun. 10, 1989 [DE] Fed. Rep. of Germany ..... 3919069

[51] Int. Cl.[5] ..... C25D 3/44

[52] U.S. Cl. ..... 205/237; 204/67

[58] Field of Search ..... 204/39, 58.5, 67

[56] References Cited

U.S. PATENT DOCUMENTS

| | | | |
|---|---|---|---|
| 2,849,349 | 8/1958 | Ziegler et al. | 204/58.5 |
| 3,268,421 | 8/1966 | McGraw | 204/39 |
| 3,448,134 | 6/1969 | McGraw | 204/39 X |
| 3,672,965 | 6/1972 | Harwood | 204/58.5 |
| 4,071,526 | 1/1978 | Dotzer et al. | 204/58.5 X |
| 4,144,140 | 3/1979 | Dotzer et al. | 204/58.5 |
| 4,152,220 | 5/1979 | Wong | 204/58.5 |
| 4,417,954 | 11/1983 | Birkle et al. | 204/58.5 |
| 4,778,575 | 10/1988 | Mayer | 204/58.5 |
| 4,948,475 | 8/1990 | Doetzer et al. | 204/58.5 |

*Primary Examiner*—John F. Niebling
*Assistant Examiner*—William T. Leader
*Attorney, Agent, or Firm*—Sprung Horn Kramer & Woods

[57] ABSTRACT

The invention relates to organoaluminum electrotyles for the electrolytic deposition of aluminum which are characterized in that they consist of KF . 2 $AlEt_3$(A), KF . 2 $AlMe_3$ (B) and MF . 2 $Al(iBu)_3$ (C), wherein M=sodium or potassium or a mixture of both, in a molar ratio of A:B:C of from 2:1:1 to 7:1:1. The organoaluminum electrolytes are dissolved in from 2 to 4.5 moles, based on the amount of MF employed, of an aromatic hydrocarbon which is liquid at 0° C. The invention further relates to a process for the electrolytic deposition of aluminum on electrically conductive materials by using said electrolytes.

7 Claims, 2 Drawing Sheets

ORGANOALUMINUM ELECTROLYTES AND PROCESS FOR THE ELECTROLYTIC DEPOSITION OF ALUMINUM

The invention relates to organoaluminum electrotyles for the electrolytic deposition of aluminum on electrically conductive materials by using soluble aluminum anodes, and to a process therefor.

Organoaluminum complex compounds have been used for the electrolytic deposition of aluminum since long (Dissertation H. Lehmkuhl, TH Aachen 1954; DE-PS 1 047 450; Z. anorg. allg. Chem. 283 (1956) 414; DE-PS 1 056 377; Chem. Ing. Tech. 36 (1964), 616). As suitable complex compounds, there have been proposed those of the general type MX . 2 $AlR_3$ which are employed either as molten salts or in the form of their solutions in liquid aromatic hydrocarbons (DE-PS 1 047 450). MX may be either alkali metal halides or onium halides, preferably the fluorides. R are alkyl groups.

There has been a much increasing interest in coating metallic work pieces with aluminum because of the excellent protection from corrosion provided by the aluminum layers and the ecological safety thereof. Therefore, the procedure of electrolytic coating with aluminum from organoaluminum electrolytes is of great technical importance, which procedure is conducted at moderate temperatures between 60° C. and 150° C. and in closed systems. To reduce the self-ignitibility of the low-melting complex NaF . 2 $AlEt_3$ {Z. anorg. allg. Chem. 283 (1956) 414} as first mainly used, the toluene solutions of said complex were employed, which measure, however, results in the decrease in the throwing power of this electrolyte and in its conductivity with increasing dilution (see FIGS. 1 and 2). Thus, it has been described already in the German Patent Specification 1 047 450 that it is not recommended to exaggerate the dilution by such solvents of the electrolytes. Conductivities and throwing power as high as possible are important criteria for the assessment of electrolyte systems. It was also with this reasoning that later on such organoaluminum electrolytes were proposed (EP-A-0 084 816) the composition of which has been defined by the general formula $MF[(m-n)AlEt_3 . nAlR_3]$ wherein M=K, Rb, Cs; R=H, $C_xH_{2x+1}$ with x=1 and from 3 to 8, at least two of the groups R being alkyl groups; m=1.3 to 2.4; and n=0.2 to 0.5. Furthermore, in the same patent specification there were proposed also solutions of said electrolytes in from 1 to 10 moles, and preferably from 1 to 5 moles, of a liquid aromatic hydrocarbon per 1 mole of KF, and especially toluene. It is true, said electrolytes exhibit an improved throwing power as compared to the NaF . 2 $AlEt_3$ system with the same amount of toluene; however, when cooled to temperatures below the electrolysis temperature of about 100° C. they tend to undergo a high amount of crystallization. The same is applicable to a lesser degree to toluene solutions of said electrolyte systems of the general formula defined hereinabove.

The following is observed for the system KF [1.6 $AlEt_3$ . 0.4 $Al(iBu)_3$] ($iBu=CH_2CHMe_2$), the only system explicitly disclosed in EP-A- 0 084 816: A mixture comprising 1 mole of toluene per 1 mole of complex does already solidify at 50° C. to such an extent that a separation by filtration of the solid and liquid phases is not possible. In the same electrolyte system comprising 2 moles of toluene per 1 mole of KF, upon cooling to 23° C. there are precipitated, as crystallizate, 44.7% by mole, and upon cooling to from +2° C. to 0° C. even 56% by mole, of the KF . 2 $AlEt_3$ potentially present in said system. From the electrolyte KF [1.6 $AlEt_3$ . 0.4 $Al(iBu)_3$] . 3.4 moles of toluene, upon cooling to from 2° C. to 0° C. there is precipitated an amount of crystallizate which corresponds to still 32% by mole of the KF . 2 $AlEt_3$ potentially present. Only a further substantial increase of the amount of toluene to in excess of 4.5 mole of toluene produces electrolytes which are still liquid down to about 0° C. However, this high dilution also reduces the electrolytic conductivity, in addition to reducing the throwing power. Nevertheless, both quantities are essentially for an assessment of the electrolyte system. For a technical application it is advantageous that the electrolyte system remains liquid also within the range of from 20° C. to 0° C., so that crystallization will not occur outside of the actual electrolytic cell in piping conduits, pump systems or reservoirs nor during the discontinuation of operation or in the case of malfunctions. However, a further dilution of the electrolyte with liquid solvent is inappropriate for the reasons already described.

It was surprisingly found that mixtures of certain organoaluminum complexes within certain narrow mixing ratios have optimum electrolyte properties notwithstanding the infavourable properties owned by their individual components. Thus, the known complexes KF . 2 $AlEt_3$ and KF . 2 $AlMe_3$ melt at 127°-129° C. and at 151°-152° C., respectively (Dissertation H. Lehmkuhl, TH Aachen 1954). Due to the relative high melting points of the two complexes, the solubilities in toluene thereof are also such that upon cooling they will readily crystallize from concentrated solutions. KF . 2 $Al(iBu)_3$, although it melts substantially lower at 51°-53° C., upon electrolysis yields gray aluminum deposits of poor quality which in addition contain potassium metal. Also the anodic current yields were poor (Dissertation H. Lehmkuhl, TH Aachen 1954).

It is the object of the present invention to find an electrolyte which in an optimal manner combines the properties required for a technical application such as a high throwing power, a conductivity as high as possible, a high current density load, and a homogeneous solubility down to temperatures of from 20° C. to 0° C.

Said object is attained by organoaluminum electrolytes for the electrolytic deposition of aluminum which are characterized in that they consist of KF . 2 $AlEt_3$ (A), KF . 2 $AlMe_3$ (B) and MF . 2 $Al(iBu)_3$ (C), wherein M=sodium or potassium or a mixture of both, in a molar ratio of A:B:C of from 2:1:1 to 7:1:1. The two last-mentioned components KF . 2 $AlMe_3$ and MF . 2 $Al(iBu)_3$ are to be present in approximately equimolar amounts.

The electrolytes according to the invention are dissolved in from 2 to 4.5 moles, based on the amount of MF employed, of an aromatic hydrocarbon which is liquid at 0° C.

As the solvents, toluene or a liquid xylene in a proportion of preferably from 3 to 4 moles, relative to the MF employed, are preferred to be used.

The presence of low amounts of NaF . 2 $AlR_3$ complex in the electrolyte causes the gloss of the aluminum layers to be enhanced. In the total electrolyte, the ratio KF:NAF should be from about 7:1 to 20:1.

Some electrolytes and the temperature ranges in which they are liquid may be set forth by way of example.

TABLE 1

| Molar mixing ratio KF.2AlEt$_3$:KF.2AlMe$_3$:MF.2Al(iBu)$_3$[b] (A) | (B) | (C) | Solvent Kind | moles per mole of MF | Liquid down to at least |
|---|---|---|---|---|---|
| | 2:1:1 | | Toluene | 2.0 | 20° C. |
| | 2:1:1 | | Toluene | 3.0 | 10° C. |
| | 2:1:1 | | Toluene<br>Xylene[a] | 1.0<br>1.0 | 20° C. |
| | 2:1:1 | | Xylene | 2.0 | 20° C. |
| | 2:1:1 | | Xylene | 3.0 | 10° C. |
| | 2:1:1 | | Toluene | 4.0 | 0° C. |
| | 3:1:1 | | Toluene | 3.5 | 10° C. |
| | 4:1:1 | | Toluene | 3.5 | 10° C. |
| | 5:1:1 | | Xylene | 3.5 | 10° C. |
| | 6:1:1 | | Toluene | 3.0 | 20° C. |
| | 6:1:1 | | Toluene | 3.5 | 10° C. |
| | 6:1:1 | | Xylene | 3.0 | 20° C. |
| | 6:1:1 | | Toluene | 4.0 | 0° C. |
| | 6.8:1:1[c] | | Toluene | 3.5 | 0° C. |

[a]meta-xylene
[b]M = K, unless otherwise specified
[c]Ratio K:Na in (C) 0.19:0.81. In the total electrolyte comprising [(A) + (B) + (C)] a ratio of K:Na of 9.9:1 ensues therefrom.

The specific conductivities at 95° C. and 130° C. are set forth hereinbelow.

TABLE 2

| Molar mixing ratio KF.2AlEt$_3$:KF.2AlMe$_3$:MF.2Al(iBu)$_3$[b] (A) | (B) | (C) | Solvent Kind | moles per mole of MF | Specific conductivity [mS · cm$^{-1}$] 95° C. | 130° C. |
|---|---|---|---|---|---|---|
| | 2:1:1 | | Toluene | 2.0 | 20.1 | |
| | 2:1:1 | | Toluene | 3.0 | 18.1 | |
| | 2:1:1 | | Toluene<br>Xylene[a] | 1.0<br>1.0 | 16.2 | |
| | 2:1:1 | | Xylene | 2.0 | 14.0 | 20.0 |
| | 2:1:1 | | Xylene | 3.0 | 11.6 | 16.4 |
| | 6:1:1 | | Toluene | 3.0 | 24.8 | |
| | 6:1:1 | | Toluene | 3.5 | 21.5 | |
| | 6:1:1 | | Xylene | 3.0 | 16.0 | 21.3 |
| | 6.8:1:1[c] | | Toluene | 3.5 | 23.2 | |

[a]meta-xylene
[b]M = K, unless otherwise specified
[c]Ratio K:Na = 9.9:1 [Total ratio for (A) + (B) + (C)].

From Table 2 it is apparent that at 95° C. xylene solutions are less conductive than equimolar toluene solutions. This effect may be approximately compensated by increasing the temperature of the xylene solutions to 130° C.

The electrolytic deposition of aluminum from the electrolytes according to the invention is conveniently carried with the use of a soluble aluminum anode from toluene solutions at 80°-105° C. and preferably 90°-100° C., and from xylene solutions at 80°-135° C. and preferably 95°-130° C. The anodic and cathodic current densities were determined to be 98-100% each. Without polarity reversal at intervals, cathodic current densities of from 1.0 to 1.2 A/dm$^2$ may be achieved with good electrolyte agitation. Shiny uniform aluminum layers are obtained. The throwing powers of the electrolytes according to the invention correspond to those of KF . 2 AlEt$_3$ . 4.0 moles of toluene, CsF . 2 AlEt$_3$ . 4.0 moles of toluene, or to that of the system mentioned in the European Patent Specification 0 084 816 of KF [1.6 AlEt$_3$ . 0.4 Al(iBu)$_3$] 4.0 moles of toluene.

EXAMPLE 1

Figure 1:
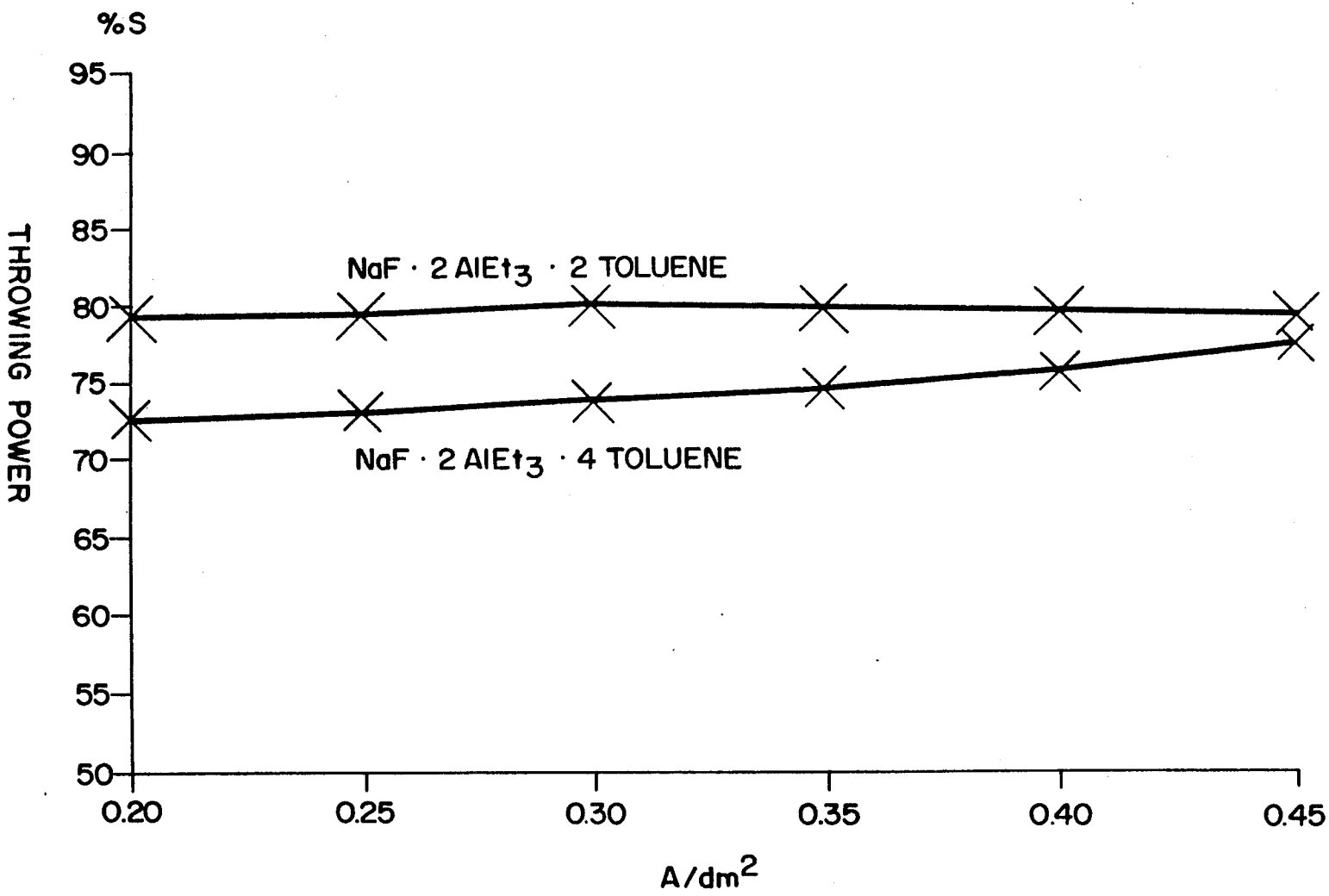
FIG. 1 shows a comparison of the throwing powers at 95° C. of NaF . 2 AlEt$_3$ plus 2 and 4 moles of toluene, respectively.
Figure 2:
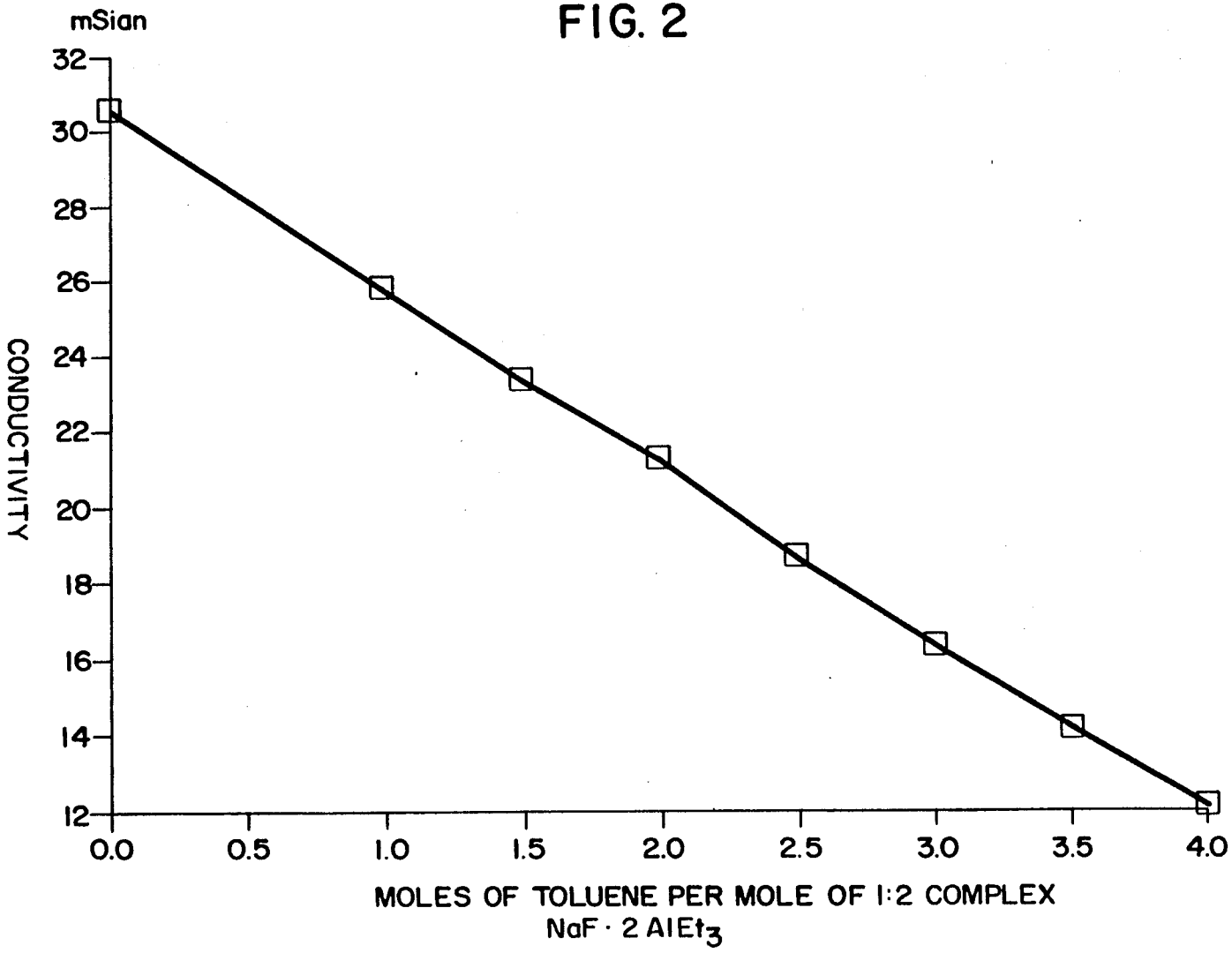
FIG. 2 shows the conductivity at 95° C. of a toluene solution of NaF . 2 AlEt$_3$ at various toluene dilutions.

KF . 2 AlEt$_3$, KF . 2 AlMe$_3$ and KF . 2 Al(iBu)$_3$ were prepared in the known manner (Dissertation H. Lehmkuhl, TH Aachen 1954) and in a molar ratio of 2:1:1 were dissolved in 3.0 moles of toluene per mole of KF. While said solution was stored for weeks at 10° C., no crystallization occurred.

EXAMPLE 2

An equal electrolyte solution was obtained by dropwise adding at 50° C. to a solution of 245.8 mmol of K[AlEt$_3$F] in 737.4 mmoles of toluene first 122.9 mmoles of Al(iBu)$_3$ followed by the 122.9 mmoles of AlMe$_3$.

EXAMPLE 3

57 mmoles of KF . 2 AlEt$_3$, 28.5 mmoles of KF . 2 AlMe$_3$ and 28.5 mmoles of KF . 2 Al(iBu)$_3$ were dissolved at 20° C. in 342 mmoles of meta-xylene to form a clear solution, from which no crystals precipitated even after several weeks of storage at 10° C.

EXAMPLE 4

A mixture of 430 mmoles of AlEt$_3$, 71.75 mmoles of AlMe$_3$ and 71.75 mmoles of Al(iBu)$_3$ was dropwise added with stirring at from 40° C. to 50° C. to a suspension of 287.0 mmoles of dried KF in 1.0 mole of toluene.

A clear solution was obtained, from which no crystals precipitated upon storage at 10° C.

EXAMPLE 5

10.2 mmoles of KF . 2 $AlMe_3$, 10.2 mmoles of KF . 2 $Al(iBu)_3$ and 61.2 mmoles of KF . 2 $AlEt_3$ were dissolved at 60°-70° C. in 30.1 ml (244 mmoles) of metaxylene. A clear solution was obtained, from which no crystals precipitated upon storage at 20° C.

EXAMPLE 6

An electrolyte according to the invention was prepared in accordance with Example 1 and subjected to electrolysis at 92° C. with a cathodic current density of 1.1 A/dm$^2$ and using an aluminum anode. A shiny uniform aluminum layer of 12.5 μm in layer thickness was obtained on the cathode. The anodic current yield calculated from the weight loss of the anode was 98%, while the cathodic current yield was quantitative.

EXAMPLE 7

The electrolyte prepared in accordance with Example 3 was electrolyzed as described in Example 6 at 100° C. at a cathodic current density of 1.2 A/dm$^2$. A shiny aluminum layer was obtained on the cathode. The anodic current yield was 97.3%, while the cathodic current yield was quantitative.

EXAMPLE 8

The electrolyte obtained in accordance with Example 4 was electrolyzed at 96°-97° C. at a current density of 1.2-1.3 A/dm$^2$ and a cell voltage of 1.6 volt for about 1 hour as described in Example 6. A very uniform shiny aluminum layer was obtained on the cathode. The anodic current yield was 99%, while the cathodic current yield was quantitative.

EXAMPLE 9

94.4 mmoles of KF . 2 $AlEt_3$, 15.7 mmoles of KF . 2 $AlMe_3$ and 15.7 mmoles of KF . 2 $Al(iBu)_3$ were dissolved in 485 mmoles of toluene, and 12.7 mmoles of liquid NaF . 2 $AtEt_3$ were added. The obtained electrolyte is absolutely identical to an electrolyte having the same analytical composition which has been prepared from 107 mmoles of KF . 2 $AlEt_3$, 15.7 mmoles of KF . 2 $AlMe_3$, 3.0 mmoles of KF . 2 $Al(iBu)_3$ and 12.7 mmoles of NaF . 2 $Al(iBu)_3$ in 485 mmoles of toluene or from 78.7 mmoles of KF . 2 $AlEt_3$, 15.7 mmoles of KF . $AlMe_3$ $AlEt_3$, 15.7 mmoles of KF . $AlEt_3$ $Al(iBu)_3$, and 15.7 mmoles of KF . $AlMe_3$ $Al(iBu)_3$ and 12.7 mmoles of NaF . 2 $AlEt_3$, in 485 mmoles of toluene. The identity of the electrolytes having equal analytical compositions results from exchange equilibria of the aluminum trialkyls between the individual complexes.

The electrolyte described here was electrolyzed at 95° C. at a cathodic current density of 0.5 A/dm$^2$ at a cell voltage of 0.7 volt. A very uniform silvery-lustrous aluminum layer was obtained on the cathode. The anodic current yield was 98%, while the cathodic current yield was quantitative.

We claim:

1. In the electrolytic deposition of aluminum on an electrolytically conductive material employing an organoaluminum electrolyte and an aluminum anode, the improvement which comprises effecting the deposition in a toluene solution of an electrolyte at a temperature of from 80° to 105° C. or in a xylene solution of an electrolyte at a temperature from 80° to 135° C. and employing as the electrolyte a mixture consisting of KF . 2 $AlEt_3$ (A), KF . 2 $AlMe_3$ (B) and MF . 2 $Al(iBu)_3$ (C), wherein M=sodium or potassium or a mixture of both, in a molar ratio of A:B:C of from 2:1:1 to 7:1:1.

2. The process according to claim 1, wherein the deposition is effected in toluene at a temperature from 90° to 100° C.

3. The process according to claim 1, wherein the deposition is effected in xylene at a temperature from 95° to 130° C.

4. Organoaluminum electrolytes for the electrolytic deposition of aluminum, characterized in that they consist of KF . 2 $AlEt_3$ (A), KF . 2 $AlMe_3$ (B) and MF . 2 $Al(iBu)_3$ (C), wherein M=sodium or potassium or a mixture of both, in a molar ratio of A:B:C of from 2:1:1 to 7:1:1.

5. Organoaluminum electrolytes according to claim 4, characterized in that they have been dissolved in from 2 to 4.5 moles, relative to the amount of MF employed, of an aromatic hydrocarbon solvent which is liquid at 0° C.

6. Electrolytes according to claim 5, characterized in that the proportion of the solvent is from 3 to 4 moles, relative to the amount of MF employed.

7. Electrolytes according to claim 5, characterized in that toluene or a liquid xylene is used as the solvent.

* * * * *